US005923233A

United States Patent [19]

Jantunen et al.

[11] Patent Number: 5,923,233

[45] Date of Patent: Jul. 13, 1999

[54] RESONATOR RESONANT FREQUENCY TUNING

[75] Inventors: Heli Jantunen; Aimo Turunen, both of Oulu, Finland

[73] Assignee: ADC Solitra Oy, Kempele, Finland

[21] Appl. No.: 08/849,973

[22] PCT Filed: Dec. 21, 1995

[86] PCT No.: PCT/FI95/00695

§ 371 Date: Jun. 20, 1997

§ 102(e) Date: Jun. 20, 1997

[87] PCT Pub. No.: WO96/19842

PCT Pub. Date: Jun. 27, 1996

[30] Foreign Application Priority Data

Dec. 21, 1994 [FI] Finland ..... 945985

[51] Int. Cl.[6] ..... H01P 7/08

[52] U.S. Cl. ..... 333/235; 333/219; 334/52

[58] Field of Search ..... 333/202, 204, 333/205, 207, 235, 223, 219; 334/45, 52, 59; 331/117 D, 107 SL

[56] References Cited

U.S. PATENT DOCUMENTS

| | | | |
|---|---|---|---|
| 3,593,225 | 7/1971 | Fisher | 333/205 |
| 4,692,724 | 9/1987 | Harris | 222/235 X |
| 5,065,121 | 11/1991 | Ghadaksaz | 333/235 |
| 5,475,350 | 12/1995 | Yamada et al. | 333/235 X |
| 5,486,797 | 1/1996 | Suzuki | 333/205 X |

FOREIGN PATENT DOCUMENTS

| | | |
|---|---|---|
| 614243 | 9/1994 | European Pat. Off. . |
| 2-55407 | 2/1990 | Japan . |
| 2139427 | 11/1984 | United Kingdom . |

*Primary Examiner*—Seungsook Ham
*Attorney, Agent, or Firm*—Klauber & Jackson

[57] ABSTRACT

In the present invention, a tuning circuit which includes a controllable switch based on a diode (D1), for example, and which is connected in parallel with a resonator, is located between the low impedance end of a center conductor (11) of a quarter wavelength resonator and ground, whereupon resonant frequency tuning is based mainly on a change in the inductance of the resonator. Voltages and power affecting a tuning circuit realized according to this invention are essentially smaller than in a circuit in which the capacitive load of a resonator is tuned by means of a similar tuning circuit located at the high impedance end of the resonator.

3 Claims, 2 Drawing Sheets

RESONATOR RESONANT FREQUENCY TUNING

BACKGROUND OF THE INVENTION

A. Field of the Invention

The present invention is related to a circuit for tuning the resonant frequency of a resonator.

B. Description of the Related Art

Electrically tunable resonators are used in high-frequency technology as a part of filters and voltage-controlled oscillators (VCO). In a filter, tuning the resonator resonant frequency affects the center frequency of the pass band or stop band of the filter, for example, allowing a tunable filter to replace several filters having a fixed center frequency. Electrical tuning may also be directed to the bandwidth of a filter. Tunable filters are beneficial in radio devices which operate in several data transfer channels and incorporate printed circuit boards which must be small and inexpensive to manufacture. A good example of a target application of a tunable filter is a modern, small-sized mobile telephone.

In a voltage-controlled oscillator (VCO), resonator tuning affects the output frequency of the oscillator. Mobile telephones also are the most important target applications of voltage-controlled oscillators. The burst mode transmissions of digital telephones based on time-division technology and the system solutions of the radio frequency part of a telephone in which a VCO operates in a wide range of frequencies place stringent requirements on resonators as far as noise resistance and the frequency tuning range are concerned.

Known procedures for electrically tuning the resonant frequency of transmission line resonators are mainly based on tuning the capacitive load at the non-grounded high impedance end of the resonator. The tuning circuit may consist of a voltage-controlled tuning circuit, for example, which consists of one or more capacitance diodes which are galvanically connected in parallel with the center conductor of the resonator, between the high impedance end and ground. A capacitance diode functions as a tunable capacitance. For example, in a coaxial resonator, a capacitance diode can be placed between the upper edge of the resonator's loaded end, or hole, and the grounded upper surface. A similar tuning circuit functions in all transmission line resonators. A wide tuning range is achieved by tuning the capacitance.

However, there are problems related to capacitance tuning. The tuning circuit significantly increases resonator loss. This results in undesirable pass band attenuation, for example, in a filter made up of resonators. Furthermore, the components commonly used in the circuits, especially capacitance diodes, can not withstand the high voltages and power produced by the strong electric field at the open end of the resonator. Overloading of the components can also be detected as unstable resonator operation. Attempts have been made to eliminate the problems created by the tuning circuit components in coaxial resonators, for example, by placing the capacitance diode in the resonator hole, where the strength of the field is near zero. However, this solution causes manufacturing problems and, in practice, it is suitable only for coaxial resonators.

One way of realizing electrical tuning of a resonator is to place another resonator, or side resonator, next to the resonator being tuned, or the main resonator, which side resonator has a resonant frequency which is suitably higher or lower than the resonant frequency of the main resonator.

One end of the side resonator has a controllable switch by which the resonator can be short circuited to ground. The controllable switch may be a capacitance diode, for example. Tuning of the resonant frequency of the main resonator by means of the side resonator is based on a connection between the resonators. The principle is that when the switch is open, the side resonator functions as a half wave resonator, whereupon its resonant frequency is so distant from the resonant frequency of the main resonator that no tuning effect is realized between the resonators. When the switch is closed, the side resonator becomes a quarter wave resonator which affects the resonant frequency of the main resonator. This method of tuning eliminates the effects of large voltages and radio frequency power on the tuning circuit, particularly on the capacitance diode. The method is mainly suitable for tuning dielectric resonators, especially strip line resonators realized on the surface of a dielectric component.

One way of tuning the resonant frequency of a helix resonator is to short circuit windings of the resonator coil with a PIN-diode, for example, causing the resonant frequency of the resonator to increase. Correspondingly, the short circuit can be removed by making the PIN-diode non-conductive, causing the resonant frequency to decrease. The tuning range is determined by the number of "short circuits" installed on the helix coil. The current flowing through the diodes, which is proportional to the voltage difference of the short circuited windings, is small compared to the current flowing between the open end of the resonator presented in conjunction with capacitance tuning and ground. This construction eliminates problems related to the tuning circuit's ability to withstand power and voltage. The problems with this method of tuning are related to its realization. The smaller the resonator is, the more difficult it is to solder "short circuits" onto the resonator coil. This method of tuning is best suited for helix antennas.

SUMMARY OF THE PRESENT INVENTION

The purpose of this invention is to realize a simple resonant frequency tuning circuit for a quarter wave transmission line resonator which does not have any of the problems presented above related to the ability of a tuning circuit to withstand power and voltage or realization of the circuit. A tuning circuit according to this invention is especially suitable for tuning the resonant frequency of a strip line resonator.

A circuit for tuning the resonant frequency of a resonator having an essentially quarter wavelength center conductor that is grounded at one end and open at the other end, and a conductive shield, the circuit comprising:

a tuning circuit that includes at least one controllable switch that, upon receiving a control signal, connects the tuning circuit in parallel with the center conductor; and the tuning circuit is galvanically connected to the conductor at a connection point whose distance from the grounded end of the center conductor is less than one half of the total length of the center conductor.

The tuning circuit is advantageously connected to the center conductor at a connection point whose distance from the grounded end of the center conductor is from one sixth to one third of the total length of the center conductor.

The tuning circuit produces an inductance which the controllable switch connects in parallel with an inductance produced in the center conductor between the connection point and the grounded end of the center conductor. In one advantageous embodiment the tuning circuit also includes a capacitance which together with the inductance forms a serial resonant circuit which has a known inductive reactance. The capacitance may be tunable, and in one advantageous realization the tuning circuit includes a capacitance diode which functions as a switch and a tunable capacitance.

In this invention, resonant frequency tuning is mainly based on a change in the inductance of a resonator. By connecting a tuning circuit below the physical halfway point of the total length of the resonator's center conductor, at the low-impedance end, the resonator can be imagined to be divided into two parts: an upper part which is essentially capacitive, and a lower part which is essentially inductive. The total inductance of the resonator is mainly produced by the parallel connection of the lower part and the tuning circuit. Said inductance is smaller than the original inductance of the resonator. Therefore, the frequency of the resonator increases as a result of the parallel connection. Stepless tuning can be realized by adding tunable capacitive elements to the tuning circuit. The capacitances and inductances of the tuning circuit thus form a serial resonant circuit whose inductive reactance is connected in parallel with the lower part of the center conductor. The voltages and power affecting a tuning circuit realized according to this invention are essentially smaller than in a circuit in which the capacitive load of a resonator is tuned at the high impedance end. The choice of components has an effect on the amount of current flowing through the tuning circuit and thereby the power loss of the components in the circuit. It is advantageous to divert most of the current in the resonator through the lower part of the resonator, as it is originally designed to withstand large currents.

BRIEF DESCRIPTION OF THE DRAWINGS

The present invention is described in detail in the following, with reference to the enclosed figures.

DESCRIPTION OF THE PREFERRED EMBODIMENT(S)

Figure 1A:
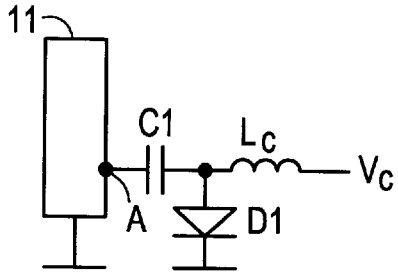
FIGS. 1*a* and 1*b* present a first tuning circuit and corresponding substitute circuit according to this invention.
Figure 1B:
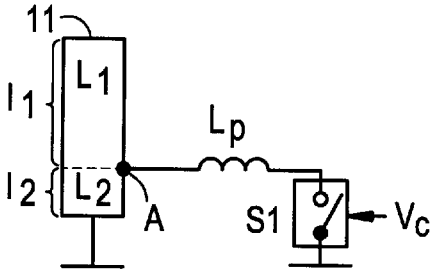

A tuning circuit according to this invention can be realized according to FIGS. 1*a* and 1*b* with a PIN-diode D1 which functions as a dual-position switch S1 which is galvanically connected via a switching capacitor C1 to a point A at the low impedance end of a resonator 11. The tuning circuit permits the resonant frequency to be switched between two tuning positions. According to this invention, the resonant frequency of the resonator 11 can be increased by causing the diode D1 to conduct by means of a control voltage $V_C$, which corresponds to the switch S1 being closed. Correspondingly, the resonant frequency can be returned to its original value by causing the diode D1 to become non-conductive, which corresponds to the switch being open. The capacitance of C1 in FIG. 1*a* is selected so the capacitor will function as a straight conductor at radio frequency, but will prevent the control voltage $V_C$ from reaching the resonator 11. Similarly, a coil $L_C$ prevents radio frequency power from entering parts of the circuit which produce the control voltage $V_C$. To illustrate the concept, the resonator is divided into two parts in relation to point A in the substitute circuit shown in FIG. 1*b*: an upper part with length $l_1$ and a lower part with length $l_2$. The total length l of the resonator is the sum of the parts $l_1$ and $l_2$, approximately equaling a quarter wavelength, ¼. According to this invention, the connection point A is at the low impedance end of the resonator, whereupon $l_2<l_1$. Correspondingly, the inductances of the upper and lower parts are $L_1$ and $L_2$, of which $L_2$ is greater than $L_1$, as is typical for a transmission line resonator. It can be seen from FIG. 1*b* that when the switch S1 is closed, the inductance $L_P$ of the tuning circuit, which is produced mainly by the switch components and the wiring of the circuit, is connected in parallel with inductance $L_2$ of the lower part of the resonator. The total inductance L of the resonator can be obtained from the expression $$L = L_1 + \frac{1}{\frac{1}{L_2} + \frac{1}{L_p}} \tag{1}$$

The total inductance L and thereby the tuning range of the resonator is influenced by the location of the connection point A. The closer the connection point A is to the grounded, low impedance end of the resonator, the smaller is the tuning range, based on expression (1).

It is known that the resonant frequency f of a resonator is defined by the equation $$f = \frac{1}{2\pi\sqrt{LC}} \tag{2}$$

where L=the total inductance of the resonator and C=the total capacitance of the resonator.

A tuning range of up to 15 MHz was attained at 450 MHz in test conditions with a tuning circuit according to this invention. In such a case, the connection point A was near the physical halfway point of the resonator, nevertheless below said halfway point, or approximately an eighth wavelength, ⅛, from the grounded end of the resonator. The value of switching capacitor was in the magnitude of 1 nF, which corresponds to a straight conductor at a 450 MHz radio frequency. Correspondingly, the $L_c$ value of the inductance can be 150 nH, for example. The achieved tuning range is sufficient for most resonator applications at said frequency range in radio telephones, for example. By choosing a suitable connection point A, the tuning range of a resonator can be affected without having to change the values of the tuning circuit components. In practice, the tuning range is selected during the manufacturing phase of the resonator component, and in many cases an advantageous connection point is from one sixth to one third of the distance from the grounded end of the center conductor.

Figure 2A:
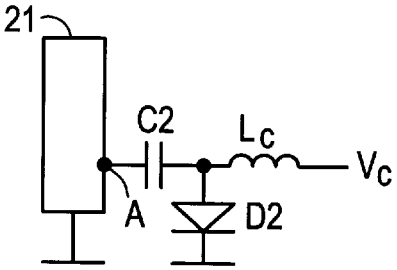
FIGS. 2*a* and 2*b* present a second tuning circuit and corresponding substitute circuit according to this invention.
Figure 2B:
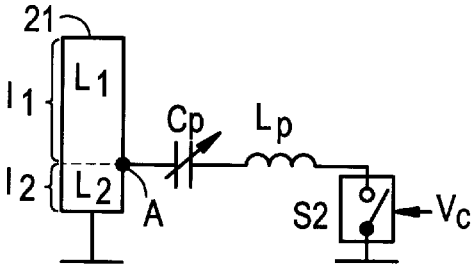

Stepless tuning of the resonant frequency of a resonator 21 can be realized with the tuning circuit of FIG. 2*a*. The circuit differs from that of the tuning circuit of FIG. 1*a* as far as capacitance is concerned. The value of the capacitance C2 is selected so that it functions as a capacitive element in the frequency range of the resonator. In such a case, when the switch S2 in the substitute circuit of FIG. 2*b* is closed, the tuning circuit functions as a serial resonant circuit connected in parallel with the resonator 21, which has a known reactive inductance $L_X$. The total inductance is defined by expression (1) by replacing the quantity $L_P$ with the inductive reactance $L_X$.

The capacitance $C_P$ is realized with a suitable tunable capacitive means, whereupon the inductive reactance $L_X$ and thereby the resonant frequency f can easily be changed by means of a control voltage, for example. FIG. 2*a* presents an advantageous tuning circuit in which the tunable capacitance is realized by means of a capacitance diode D2 which also functions as a switch, if necessary. The relationship between the capacitance C2 and the capacitance of the capacitance diode D2 affects the direction of tuning of the resonant frequency by means of a known control voltage.

The resistance caused by the tuning circuit has been ignored in the substitute circuits of FIGS. 1*b* and 2*b* for simplicity.

Figure 5:
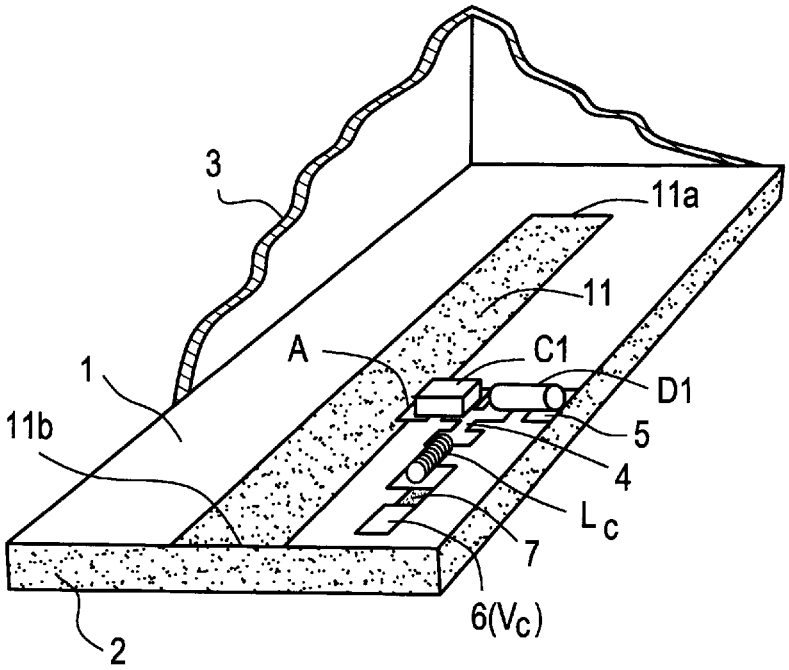
FIG. 5 presents a schematic perspective view of a possible realization of the resonator of FIG. 1*a*.
Figure 3:
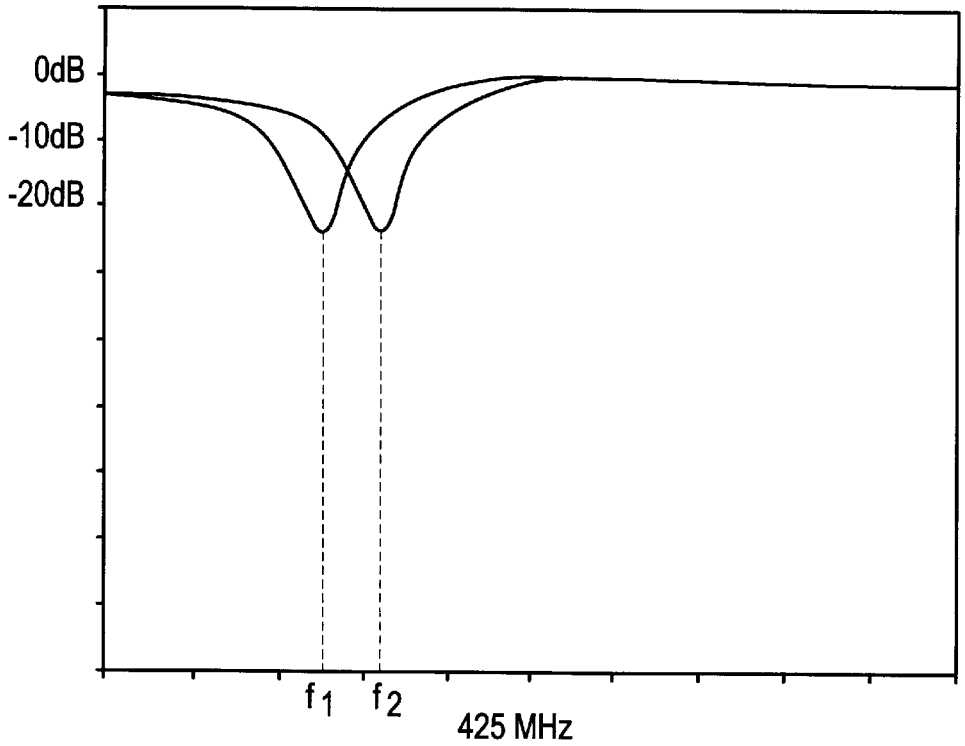
FIG. 3 shows a change in resonant frequency in a frequency level produced by the tuning circuit of FIG. 1*a*.

FIG. 5 schematically illustrates a possible realization of a resonator according to FIG. 1*a*, and FIG. 3 shows an example of a change in resonant frequency in this tuning circuit based on a dual-position switch. The resonator of FIG. 5 is a strip line resonator in which an insulating base plate 1 of a suitable material has a center conductor 11 which is connected by its low impedance end 11*b* to a ground plane 2 surrounding the edges and bottom of the base plate. The high impedance end of the center conductor is labeled with a reference number 11*a*. The ground plane 2 and a conductive casing 3 connected to said ground plane, which casing is only partly shown in FIG. 5, together form a shield of the resonator. According to the circuit of FIG. 1*a*, a capacitor C1 is galvanically connected to a point A of the resonator near its low impedance end, and a PIN diode D1 is connected from said capacitor to a conductor area 5 which is connected to the ground plane 2. From a point between the capacitor C1 and diode D1, a coil $L_C$ is connected via a current-limiting resistor 7 to a control connector 6 to which is connected a control voltage $V_C$. The values of the components of a tuning circuit which produces a change in resonant frequency shown in FIG. 3 are: capacitance C1 9 pF, inductance $L_C$ 220 nH, control voltage $V_C$ 5 V and resistor 7 390 ohms. Switch D1 is realized with a PIN diode BA682. When the diode D1 conducts, or the switch is closed, the resonant frequency increases from $f_1$ to $f_2$ as shown in FIG. 3, which corresponds to a change of about 5 MHz in a 425 MHz frequency range (1 square equals about 5 MHz). The connection point A of the tuning circuit is about 4.5 mm from the grounded end of the resonator. In this circuit, the value of the capacitance C1 is so small that it functions as a capacitive element at said 425 MHz frequency range, so the tuning circuit corresponds to the serial resonant circuit of the substitute circuit of FIG. 2*b*. The magnitude of the tuning range is affected by changing the value of the capacitance C1. For example, if the value of the capacitance C1 is 18 pF, the resulting tuning range is 15 MHz. A comparison of the Q-value of the resonator at resonant frequency $f_1$ before tuning and at resonant frequency $f_2$ after tuning showed no change in said value.

Figure 4:
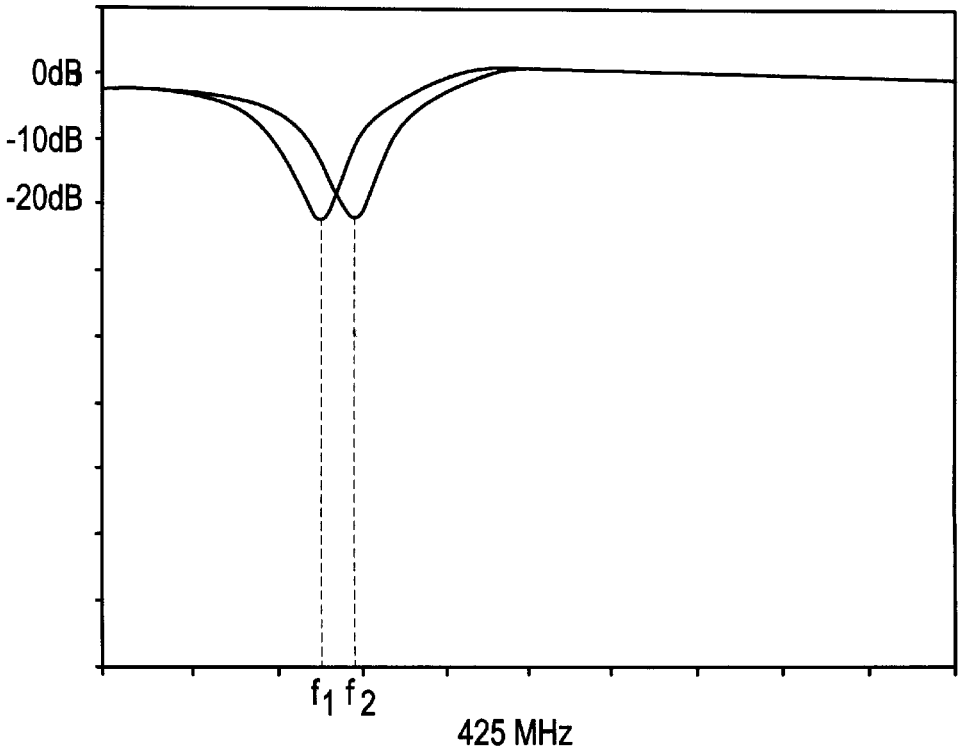
FIG. 4 shows a change in the resonant frequency produced by the tuning circuit of FIG. 2*a* at a certain frequency level.

FIG. 4 shows the effect of tuning the resonant frequency of a resonator according to FIG. 2*a* on a band stop capacitor in regard to frequency. The capacitance value in the tuning circuit is 14 pF. A 150 kohm resistor has been added to the control voltage line to limit the current to the correct level. The switch is realized with a capacitance diode SMV 1204-99. Varying the control voltage $V_c$ within the range of 0 V–4 V causes the resonant frequency to increase from $f_1$ to $f_2$ according to FIG. 4, which corresponds to a change of about 2.5 MHz in a 425 MHz frequency range (1 square equals about 5 MHz).

Resonant frequency tuning can be realized with the circuit according to this invention which does not cause power loss in a resonator as do tuning circuits of the prior art which tune the capacitive load at the open end of a resonator. Neither do large voltages affect this tuning circuit, as it is known that the electric field is weak in the vicinity of the grounded end of a resonator. Therefore, overloading which could affect tuning stability or component life is not directed to the components of this tuning circuit. Furthermore, tests have indicated that tuning according to this invention does not seem to affect the Q-value of the resonator, contrary to tuning methods of the prior art, in which the Q-value usually gets worse as a result of tuning. This is especially beneficial in VCO applications.

A tuning circuit according to this invention is easy to realize especially in a strip line resonator, for example, by connecting tuning circuit into a suitable location of the resonator near its low impedance end. In principle, the tuning circuit can also be applied to other transmission line resonators. For example, the tuning circuit of a helix resonator is easier to manufacture according to this invention than by implementing "short circuits" according to the prior art, because according to this invention, a resonator coil connection only has to be made at one point.

Tuning circuit component selection affects tuning accuracy, speed and, in part, also range. A rough tuning range is determined by the location of the connection point A. A tuning range is achieved by means of this invention which is no more than approximately 10% of the resonant frequency. Such a range is sufficient for practical radio telephone applications and also in most other resonator applications. The examples presented above do not limit the invention, but rather the described tuning circuit may be applied to the extent allowed by the enclosed claims.

I claim:

1. A circuit for tuning the resonant frequency of a resonator having an essentially quarter wavelength center conductor that is grounded at one end and open at the other end, and a conductive shield said circuit comprising:

a tuning circuit includes at least one controllable switch that, upon receiving a control signal, connects said tuning circuit in parallel with the center conductor; and said tuning circuit is galvanically connected to the conductor at a connection point whose distance from said grounded end of said center conductor is less than one half of the total length of said center conductor;

wherein said tuning circuit produces a circuit inductance, and said controllable switch connects in parallel with a center conductor inductance produced between said connection point of said center conductor and said grounded end of said center conductor;

wherein said tuning circuit includes a capacitance, that together with said circuit inductance forms a serial resonant circuit that has a certain inductive reactance;

wherein said capacitance is a tunable capacitance;

wherein said tuning circuit includes a capacitance diode that functions as said controllable switch and said tunable capacitance.

2. A circuit for tuning the resonant frequency of a resonator having an essentially quarter wavelength center conductor that is grounded at one end and open at the other end, and a conductive shield said circuit comprising:

a tuning circuit includes at least one controllable switch that, upon receiving a control signal, connects said tuning circuit in parallel with said center conductor; and said tuning circuit is galvanically connected to said conductor at a connection point whose distance from said grounded end of said center conductor is less than one half of the total length of said center conductor;

wherein said tuning circuit is connected to said center conductor at said connection point whose distance from said grounded end of said center conductor is from one sixth to one third of the total length of said center conductor;

wherein said tuning circuit produces a circuit inductance, and said controllable switch connects in parallel with a center conductor inductance produced between said connection point of said center conductor and said grounded end of said center conductor;

wherein said tuning circuit includes a capacitance, that together with said circuit inductance forms a serial resonant circuit that has a certain inductive reactance;

wherein said capacitance is a tunable capacitance;

wherein said tuning circuit includes a capacitance diode that functions as said controllable switch and said tunable capacitance.

3. A circuit for tuning the resonant frequency of a resonator having an essentially quarter wavelength center conductor that is grounded at one end and open at the other end, and a conductive shield, said circuit comprising:

a tuning circuit includes at least one controllable switch that, upon receiving a control signal, connects said tuning circuit in parallel with said center conductor;

said tuning circuit is galvanically connected to said conductor at a connection point whose distance from said grounded end of said center conductor is less than one half of the total length of said center conductor; and said tuning circuit includes an impedance for determining a resonant frequency of said resonator;

wherein said tuning circuit produces a circuit inductance, and said controllable switch connects in parallel with a center conductor inductance produced between said connection point of said center conductor and said grounded end of said center conductor;

wherein said tuning circuit includes a capacitance, that together with said circuit inductance forms a serial resonant circuit that has a certain inductive reactance;

wherein said capacitance is a tunable capacitance;

wherein said tuning circuit includes a capacitance diode that functions as said controllable switch and said tunable capacitance.

* * * * *